US009138770B2

(12) United States Patent
Chen

(10) Patent No.: US 9,138,770 B2
(45) Date of Patent: Sep. 22, 2015

(54) DYEING DEVICE FOR APPLYING DYE TO COLUMNAR OBJECTS

(71) Applicant: HON HAI PRECISION INDUSTRY CO., LTD., New Taipei (TW)

(72) Inventor: Po-Chou Chen, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 52 days.

(21) Appl. No.: 13/928,756

(22) Filed: Jun. 27, 2013

(65) Prior Publication Data

US 2014/0174345 A1 Jun. 26, 2014

(30) Foreign Application Priority Data

Dec. 21, 2012 (TW) ..... 101149087 A

(51) Int. Cl.

| | |
|---|---|
| ***B05C 1/08*** | (2006.01) |
| ***B05C 1/14*** | (2006.01) |
| *D06B 1/10* | (2006.01) |

(52) U.S. Cl.

CPC ..... *B05C 1/14* (2013.01); *B05C 1/0821* (2013.01); *D06B 1/10* (2013.01)

(58) Field of Classification Search

CPC ..... B05C 1/14; B05C 1/0821; D06B 1/10
USPC ..... 118/233, 239, 257, 106, 416, 426, 428; 68/200, 202
See application file for complete search history.

(56) References Cited

U.S. PATENT DOCUMENTS

| | | | | | |
|---|---|---|---|---|---|
| 506,184 | A * | 10/1893 | McDonald | ..... | 228/29 |
| 2,868,162 | A * | 1/1959 | Knain | ..... | 118/219 |
| 3,695,223 | A * | 10/1972 | Dunham et al. | ..... | 118/217 |
| 6,581,418 | B1 * | 6/2003 | Kim | ..... | 68/200 |

* cited by examiner

*Primary Examiner* — Laura Edwards
(74) *Attorney, Agent, or Firm* — Novak Druce Connolly Bove + Quigg LLP

(57) ABSTRACT

A device for dyeing columnar objects rotates the columnar object as they brush past an endless, absorbent, dye-carrying belt. The colored dye from the belt rubs off onto the columnar object, providing an even and consistent coating of dye.

7 Claims, 1 Drawing Sheet

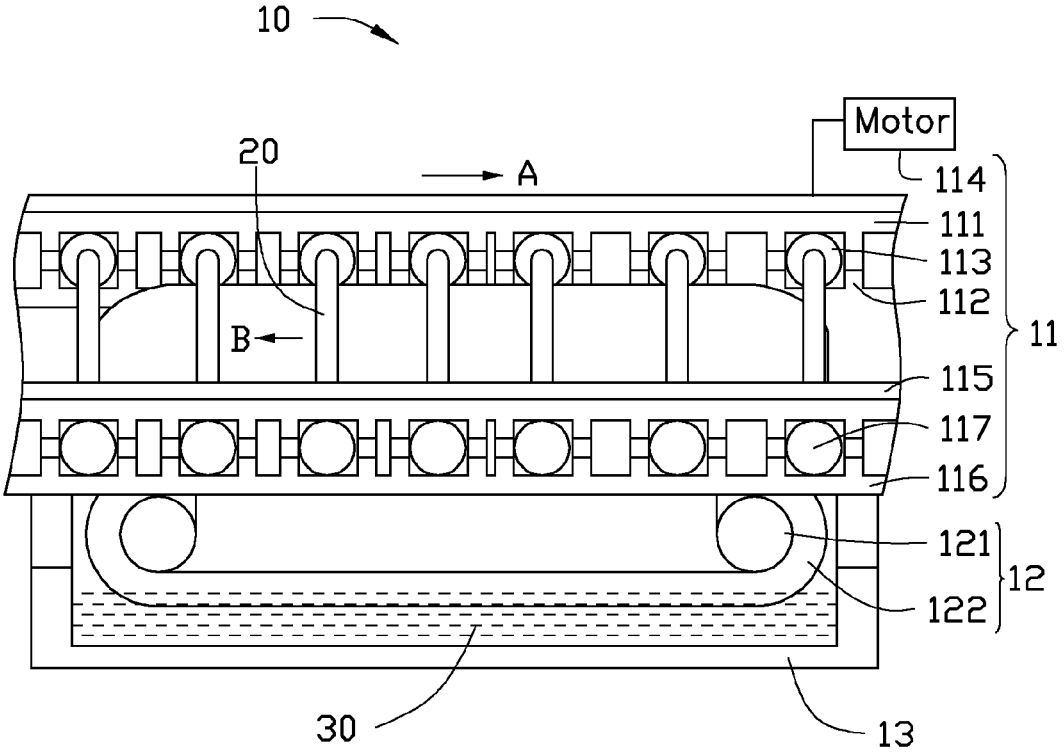
10
Motor
20
A
114
111
113
112
11
B
115
117
116
121
12
122
30
13

DYEING DEVICE FOR APPLYING DYE TO COLUMNAR OBJECTS

BACKGROUND

1. Technical Field

The present disclosure relates to application of dye to objects of particular shape.

2. Description of Related Art

Electronic incense stick is a light guide body having an opaque outer coating on its outer surface and a semi-spherical portion on its top end. Light emitted from a light source is guided to the semi-spherical portion to simulate a burning traditional incense stick.

In manufacturing, the outer surface of the light guide body is manually colored to form the opaque outer coating. The manual coloring wastes time and manpower, and the outer color-coating of multiple light guide bodies may have different thicknesses.

Therefore, it is desirable to provide a dyeing device which can overcome the limitations described.

BRIEF DESCRIPTION OF THE DRAWINGS

The components of the drawings are not necessarily drawn to scale, the emphasis instead being placed upon clearly illustrating the principles of the embodiments of the present disclosure.

The FIGURE is a schematic view of an embodiment of a dyeing device for applying dye to the surface of a columnar object.

DETAILED DESCRIPTION

The FIGURE shows a dyeing device 10, in accordance with an embodiment. The dyeing device 10 is used for applying dye to outer surfaces of a plurality of columnar objects 20. The columnar objects 20 can be electronic incense sticks.

The dyeing device 10 includes an operating unit 11, a dyeing unit 12, and a dye container 13. The operating unit 11 takes the columnar objects 20 to move in a first direction labeled A. The dye container 13 holds dye 30 therein. The dyeing unit 12 moves in a second direction labeled B in order to coat the dye 30 onto the outer surface of each columnar object 20. The second direction is the reverse of the first direction.

The operating unit 11 includes a first top chain 111, a first bottom chain 112, a second top chain 115, a second bottom chain 116, a plurality of first holders 113, a plurality of second holders 117, and a motor 114. All of the first top chain 111, the first top chain 111, the second top chain 115, and the second bottom chain 116 are endless. The first top chain 111 is parallel with the first bottom chains 112, the second top chain 115, and the second bottom chain 116. The first top chain 111 is located above the first bottom chain 112 and the first holders 113 are located between the first top chain 111 and the first bottom chain 112. Each of the first holders 113 is used for supporting one end of each of the columnar objects 20. The second top chain 115 is located above the second bottom chain 116 and the second holders 117 are located between the second top chain 115 and the second bottom chain 116. Each of the second holders 117 is for supporting the other end of each of the columnar objects 20. In other words, one end of each columnar object 20 is sandwiched between the first top chains 111 and the first bottom chain 112 and the other end of each columnar object 20 is sandwiched between the second top chain 115 and the second bottom chain 116.

The motor 114 is used for driving the first top chain 111, the first bottom chain 112, the second top chain 115, and the second bottom chain 116 at a same speed to move in the first direction. In other words, the columnar objects 20 can move along with the operating unit 11 in the first direction. No relative motion exists between the first top chain 111 and the first bottom chain 112 during the first top chain 111 and the first bottom chain 112 are driven to move in the first direction. No relative motion exists between the second top 115 and the second bottom chain 116 during the second top chain 115 and the second bottom chain 116 are driven to move in the first direction. In one embodiment, the motor 114 can also drive the first holders 113 and the second holders 117 to rotate the columnar objects 20 at a same speed.

In another embodiment, the first holders 113 and second holders 117 can be omitted. The columnar objects 20 are fixed between the first top chain 111 and the first bottom chains 112, and are fixed between the second top chain 115 and the second bottom chain 116. The columnar objects 20 rotate by virtue of friction, for example, between the columnar objects 20 and the dyeing unit 12.

The dyeing unit 12 includes two rollers 121 and an endless belt 122. The belt 122 winds around the two rollers 121. The two rollers 121 take the belt 122 to move along the second direction. The material of the belt 122 is, for example, cotton, sponge, or fiber. The width of the belt 122 is not less than the dyeing length of the columnar objects 20 or other object being dyed.

The dye container 13 is for holding dye 30 therein. The two rollers 121 rotate and the belt 122 is immersed into the dye 30. The dye 30 is absorbed by the belt 122. When the columnar objects 20 contact the belt 122, the dye 30 of the belt 122 rubs off onto the surface of each columnar object 20.

In the processing, the motor 114 drives the operating unit 11 holding and rotating the columnar objects 20, to move in the first direction. The belt 20 moves in the second direction. The columnar objects 20 rotate relative to the belt 122 and make physical contact as they brush past it, so the dye 30 of the belt 122 is evenly coated on the surface of each columnar object 20.

It is believed that the present embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. A dyeing device for dyeing a surface of a columnar object, the dyeing device comprising:

an operating unit for driving the columnar object moving in a first direction;

a dyeing unit moving in a second direction and dyeing a dye onto the surface of the columnar object, the second direction reverse to the first direction; and a dye container for containing dye and locating under the dyeing unit to apply the dye for the dyeing unit;

wherein the operating unit comprises a first holder and a second holder for supporting the two ends of the columnar object.

2. The dyeing device of claim 1, wherein the operating unit comprises a first top chain, a first bottom chain, a second top chain, and a second chain, one end of the columnar object is sandwich between the first top chain and the first bottom chain, and the other end of the columnar object is sandwich between the second top chain and the second bottom chain.

3. The dyeing device of claim 2, wherein the first holder is located between the first top chain and the first bottom chain for fixing one end of the columnar object, the second holder is located between the second top chain and the second bottom chain for fixing the other end of the columnar object.

4. The dyeing device of claim 2, wherein the operating unit comprises a motor for driving the first and second top chains, the first and second bottom chains, and the first and second holders.

5. The dyeing device of claim 1, wherein a friction force between the dyeing unit and the columnar object makes the columnar object rotate.

6. The dyeing device of claim 5, wherein the dyeing unit comprises two rollers and a belt, the belt winds around the two rollers and the two rollers rotate in the second direction.

7. The dyeing device of claim 6, wherein a material of the belt is selected from the group consisting of cotton, sponge, and fiber.

* * * * *